United States Patent [19]

Nagasawa et al.

[11] Patent Number: 4,769,574

[45] Date of Patent: Sep. 6, 1988

[54] INCANDESCENT LAMP WITH A METAL COUPLING TO A PLASTIC LAMP BASE FOR AUTOMOTIVE HEADLAMP AND LIKE LIGHTING APPLICATIONS

[75] Inventors: Masakazu Nagasawa; Mitsuhiro Okano, both of Shimizu, Japan

[73] Assignee: Koito Seisakusho Co., Ltd., Tokyo, Japan

[21] Appl. No.: 83,948

[22] Filed: Aug. 4, 1987

[30] Foreign Application Priority Data

Aug. 4, 1986 [JP] Japan ..... 61-183203
Jun. 18, 1987 [JP] Japan ..... 62-152102

[51] Int. Cl.[4] ..... H01J 5/14

[52] U.S. Cl. ..... 313/318; 313/50; 362/296

[58] Field of Search ..... 313/50, 51, 318, 578, 313/579, 113; 362/285, 288, 296, 306, 368, 370, 371, 372; 439/36, 220, 222

[56] References Cited

U.S. PATENT DOCUMENTS 3,510,718 5/1970 Vetere ..... 313/318
4,122,367 10/1978 Esklavon et al. ..... 313/318
4,412,273 10/1983 Helbig et al. ..... 313/318
4,567,397 11/1986 Wilhelm et al. ..... 313/318
4,569,006 2/1986 Bergin et al. ..... 313/318
4,641,056 2/1987 Sanders et al. ..... 313/318

*Primary Examiner*—David K. Moore
*Assistant Examiner*—Michael Horabik
*Attorney, Agent, or Firm*—Browdy and Neimark

[57] ABSTRACT

For coupling a halogen incandescent lamp to a plastic lamp base in correct positional relationship, a sheet-metal lamp holder is rigidly engaged with a hermetic end seal of the lamp, and a sheet-metal sleeve is anchored in the lamp base. The sleeve has several connecting fingers extending therefrom for somewhat loose engagement in openings in the lamp holder. The loose engagement of the sleeve fingers in the lamp holder openings permit adjustment of the positions of the lamp and the lamp base, which are secured respectively to the lamp holder and to the lamp base, with respect to each other. The sleeve fingers are welded to the lamp holder following the adjustment of the positional relationship between the lamp and the lamp holder.

6 Claims, 10 Drawing Sheets

INCANDESCENT LAMP WITH A METAL COUPLING TO A PLASTIC LAMP BASE FOR AUTOMOTIVE HEADLAMP AND LIKE LIGHTING APPLICATIONS

BACKGROUND OF THE INVENTION

This invention relates to eletric lamps and has particular pertinence to a baseless incandescent lamp, such as that of halogen-cycle type, combined with a plastic lamp base for vehicular use. Still more particularly, the invention pertains to an electric lamp assembly having metal-made coupling means providing for mechanical and electrical connection, as well as positional adjustment between the lamp and the lamp base.

The combination of a halogen-cycle incandescent lamp and a plastic lamp base is per se not new in the art but is disclosed in for example U.S. Pat. No. 4,412,273 to Helbig et al. The plastic lamp base permits manufacture at lower cost than metal-made ones and, moreover, provides a yieldable connection between the lamp and an automotive headlamp reflector which may be of an unyielding material. For connecting the lamp to the lamp base so as to permit adjustment of the lamp position, Helbig et al. employ a metal sleeve secured to the lamp, and a metal-made adjustment cap in which is seated the lamp and which is telescopically received in the sleeve. The telescoping sleeve and cap permit adjustment of the lamp filament or filaments so that light may be emitted in a predetermined pattern with respect to the base. With the adjustment completed, the sleeve and cap are welded together.

An objection to this prior art lamp assembly is that the telescoping sleeve and cap are, before being welded together, susceptible to both angular and axial displacements relative to each other. Such susceptibility of the mating parts to relative displacements has been prone to permit the lamp to go out of alignment with the lamp base before or during the welding of the sleeve and cap.

SUMMARY OF THE INVENTION

The invention overcomes the noted weaknesses and inconveniences of the prior art by providing an improved connection between a lamp and a lamp base.

Briefly the invention may be summarized as an electric lamp assembly comprising a baseless incandescent lamp having an envelope containing a filament, with lead wires connected to the filament and extending from the envelope through a hermetic seal terminating one end thereof. A plastic lamp base for combined use with the lamp has connector means mounted thereto and electrically coupled to the lamp lead wires. By way of an adjustable connection between the lamp and the lamp base there are employed a metal-made lamp holder and a metal-made sleeve. The lamp holder comprises a holder portion rigidly holding the lamp envelope seal, and a seating portion having a plurality of openings defined therein and also having a plurality of lugs disposed one adjacent each opening. The sleeve, on the other hand, is rigidly anchored in the lamp base and has a plurality of fingers extending therefrom. The sleeve fingers are loosely engaged in the respective openings in the seating portion of the lamp holder and welded or otherwise rigidly joined to the respective lugs thereon.

Thus, in lieu of the conventional telescopic connection, the invention employs metal fingers extending from the sleeve anchored in the lamp base and somewhat loosely engaged in the openings in the lamp holder rigidly holding the lamp. The loose engagement of the sleeve fingers in the lamp holder openings enables ables the positional adjustment of the lamp with respect to the lamp base before the welding of the sleeve fingers to the lamp holder lugs. Nevertheless, the undesired relative angular or axial displacements of the lamp holder and the sleeve are reduced to an absolute minimum.

The above and other features and advantages of this invention and the manner of realizing them will become more apparent, and the invention itself will best be understood, from a study of the following description and appended claims, with reference had to the attached drawings showing some preferable embodiments of the invention.

DESCRIPTION OF THE PREFERRED EMBODIMENTS

Figure 1:
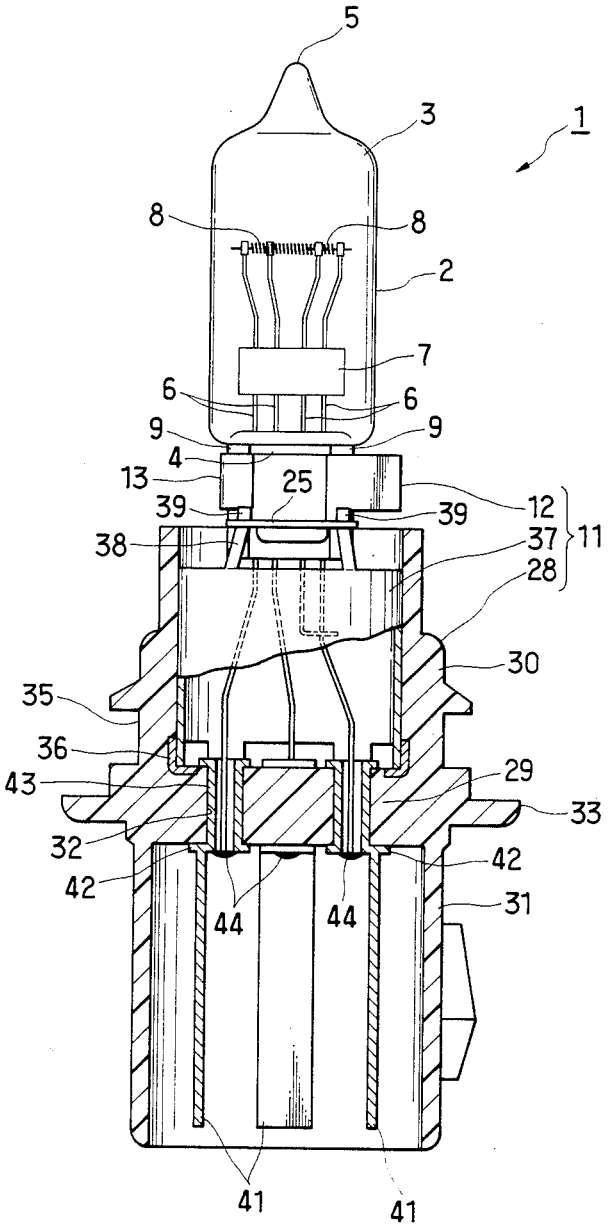
FIG. 1 is an axial section, partly in elevation, through the halogen-cycle incandescent lamp assembly constructed in accordance with the principles of the invention for automotive headlamp application.

The present invention will now be described in terms of a two-filament, halogen-cycle incandescent lamp assembly for automotive headlight applications. As illustrated in an upstanding attitude in FIGS. 1-3, the exemplified lamp assembly 1 includes a halogen lamp 2 having a vitreous envelope 3 of suitable high-temperature material. The envelope 3 is hermetically closed to contain an inert gas and a measured amount of a halogen either in elemental form or in the form of a suitable halogen-containing compound. The halogen lamp 2 is of the baseless type, having a familiar pinch or press seal 4 terminating one end, shown directed downwardly, of the envelope 3, and an exhaust tip 5 at the other end of the envelope.

Extending through, and rigidly supported by, the lamp seal 4 are two pairs of lead wires 6 which, within the envelope 3, are sandwiched between a pair of fused-on bridges 7 of vitreous material thereby to be retained in spaced-apart positions. Two coiled filaments 8 are connected one between the ends of each pair of lead wires 6.

Figure 3:
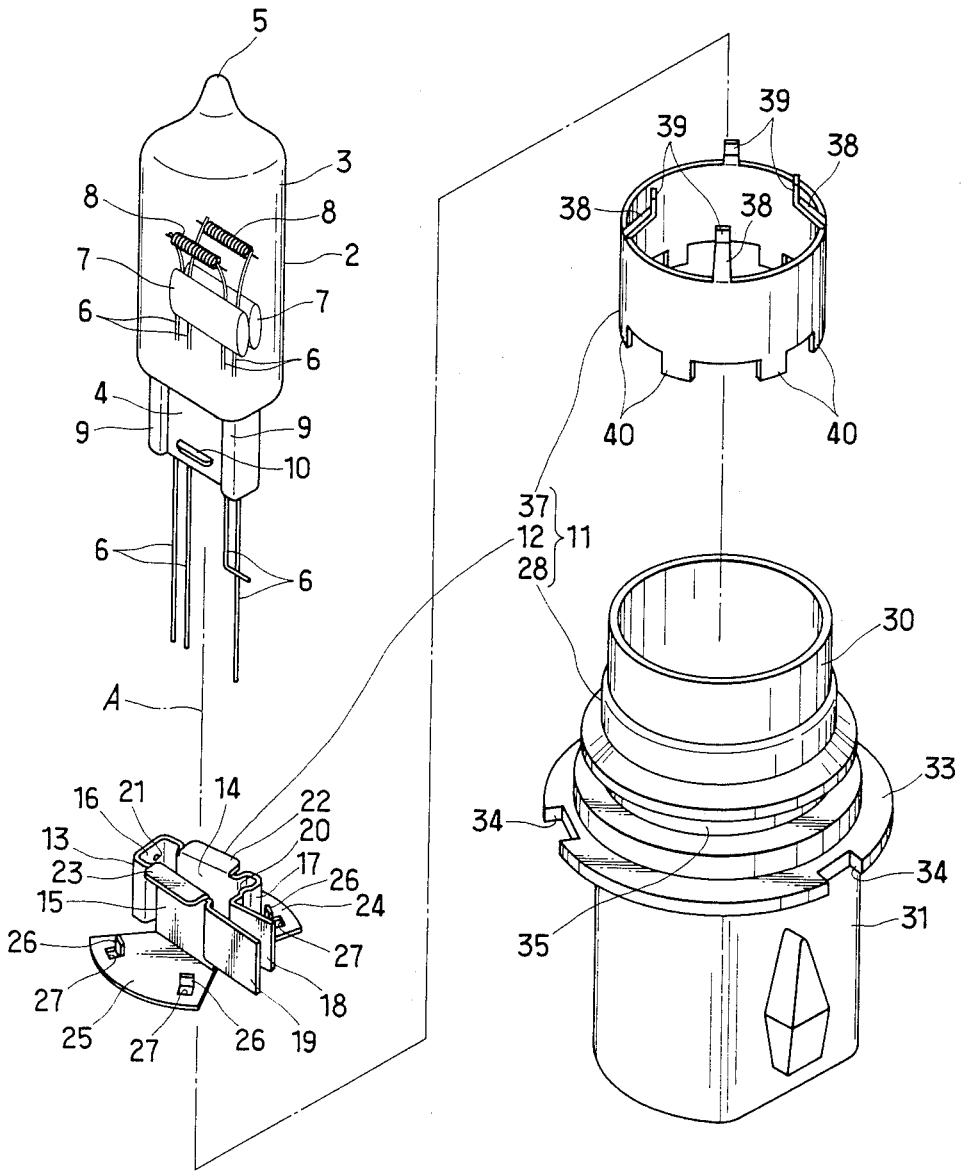
FIG. 3 is an exploded perspective view of the lamp assembly.

As best seen in FIG. 3, the lamp seal 4 is of generally I-shaped cross section, having a pair of longitudinal side flanges 9 extending parallel to the center axis A of the lamp 2. The lamp base 4 is further formed to include a pair of transverse ridges 10, one seen, which are located on the opposite sides of its web portion and which extend at right angles with the flanges 9 and, therefore, with the lamp axis A.

Figure 2:
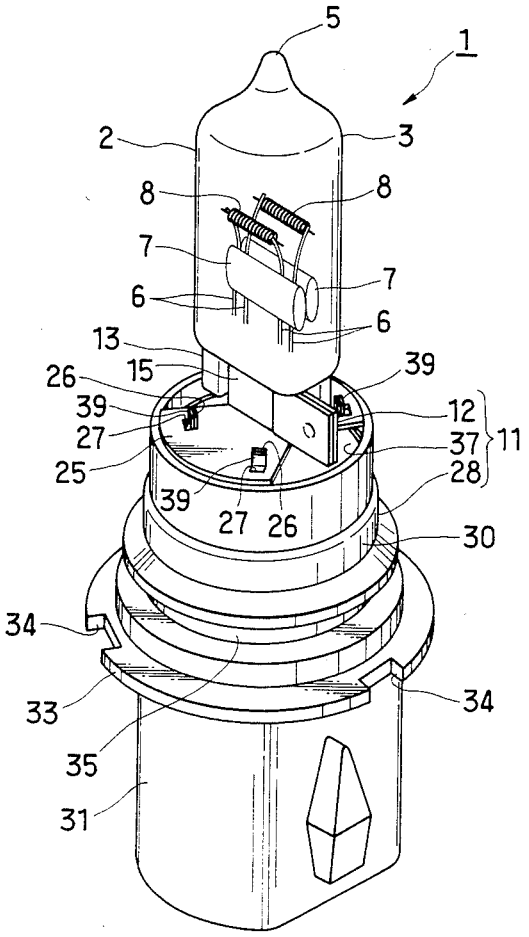
FIG. 2 is a perspective view of the lamp assembly.

The reference numeral 11 in FIGS. 1–3 generally denotes the means for mechanically mounting the halogen lamp 2 in place on a motor vehicle headlamp assembly, not shown, and for providing electrical connection to an associated power circuit, also not shown. The lamp mounting means 11 comprises a sheet-metal lamp holder 12, a plastic lamp base 28, and a metal-made sleeve 37, which will be detailed hereafter in that order.

Figure 4:
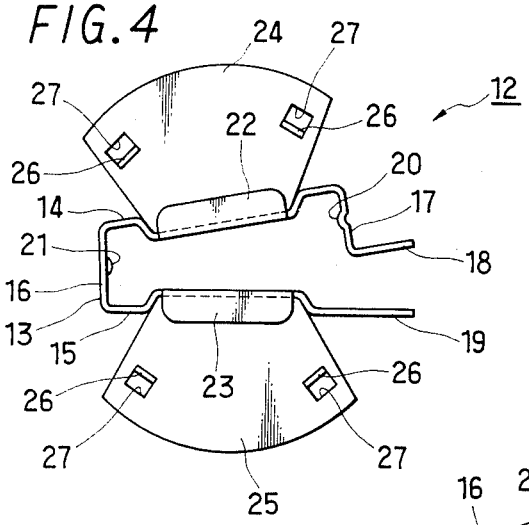
FIG. 4 is an enlarged plan view of the sheet-metal lamp holder used in the lamp assembly of FIG. 1.
Figure 5:
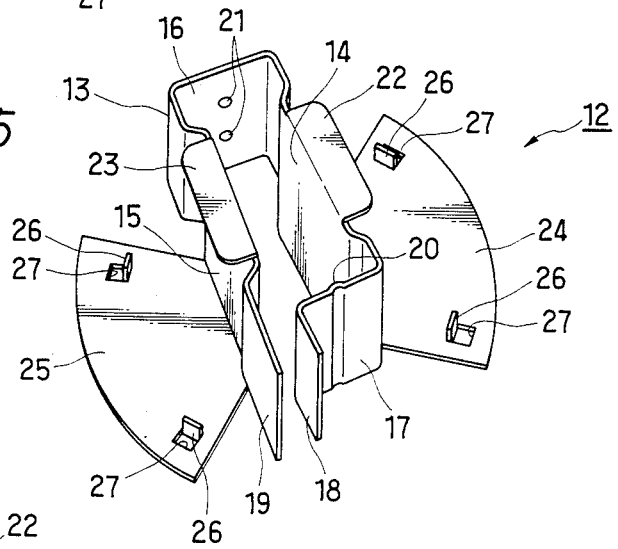
FIG. 5 is a perspective view of the lamp holder.

As illustrated on an enlarged scale in FIGS. 4 and 5, the lamp holder 12 is shown as a pressing of resilient sheet-metal material, integrally comprising a holder portion 13 and a pair of sector-shaped seating portions 24 and 25. Closely encircling the lamp seal 4, the holder portion 13 is of generally tubular shape having a pair of opposite longer sides 14 and 15, a first shorter side 16 right-angularly joining the longer sides 14 and 15 each at one end thereof, and a second shorter side 17 bent right-angularly from the other end of the longer side 14 into opposed relation to the first shorter side 16. The second shorter side 17 has a fin 18 bent right-angularly therefrom in a direction away from the first shorter side 16. Another fin 19 extends from the longer side 15 into opposed relation to the fin 18. These fins 18 and 19 are to be welded or otherwise joined flatwise to each other when the lamp holder 12 is mounted in place as in FIGS. 1 and 2.

It will be noted that the pair of longer sides 14 and 15 of the holder portion 13 have their midportions depressed toward each other. When the fins 18 and 19 are joined together, the holder portion 13 bounds a space of approximately the same shape and size as the cross section of the lamp seal 4. The pair of longer sides 14 and 15 are to be held against the opposite sides of the web portion of the lamp seal 4, and the pair of shorter sides 16 and 17 against the pair of flanges 9 of the lamp seal.

The shorter side 17 of the holder portion 13 has a ridge or linear protuberance 20 extending along the lamp axis A and protruding toward the other shorter side 16. This shorter side 16 also has a plurality of, two in this embodiment, dot-like protuberances 21 which are spaced from each other along the lamp axis A and which protrude toward the side 17. While the provision of the two or more dot-like protuberances 21 on the side 16 is recommended, the ridge 20 on the side 17 may be replaced by, for example, a dot-like protuberance located at or adjacent the midpoint of its dimension along the lamp axis A. A pair of lamp retainer tabs 22 and 24 are bent approximately right-angularly away from each other from the pair of longer sides 14 and 15.

Also extending from the pair of longer sides 14 and 15 are the noted pair of seating portions 24 and 25 which are both contained in a plane at right angles with the lamp axis A and which are shaped like sectors of a common circle having a diameter approximately equal to, or slightly less than, the inside diameter of the metal sleeve 37. Each seating portion has a pair of punchedout lugs 26, creating openings 27 therein.

The halogen lamp 2 and the lamp holder 12 may be assembled by first inserting the lamp seal 4 in the holder portion 13 of the lamp holder, with the fins 18 and 19 held slightly open as in FIGS. 4 and 5, until the lamp envelope 3 comes to rest on the pair of retainer tabs 22 and 23. Then, as the fins 18 and 19 are closed against each other, the pair of longer sides 14 and 15 of the holder portion 13 will fit closely against the opposite sides of the lamp seal 4, with the proximal ends of the seating portions 24 and 25 engaging the transverse ridges 10 thereon. Then the fins 18 and 19 may be secured to each other as by spot welding. Now the lamp 2 and lamp holder 12 have been firmly coupled together, with their relative displacement in either direction along the lamp axis A being prevented by the pair of lamp retainer tabs 22 and 23 of the lamp holder and by the pair of tranverse ridges 10 on the lamp seal 4.

Further, in accordance with a feature of the invention, the dot-like protuberances 21 on the holder side 16 and the ridge 20 on the holder side 17 are resiliently held against the pair of flanges 9 of the lamp seal 4, so that the lamp 2 is held all the more firmly by the lamp holder 12. It will also be appreciated that the protuberances 20 and 21 can adapt themselves, to some extent, to the shape of the lamp seal 4, making it possible for the lamp holder 12 to positively support the lamp 2 in the face of possible dimensional errors in the fabrication of the lamp seal.

With reference directed back to FIGS. 1–3 the lamp base 28 is a one-piece molding of a plastic, preferably a thermoplastic. Substantially tubular in shape, the lamp base 28 has a lamp support portion 30 and a connector portion 31, with a partition 29 and flange 33 at the boundary between the two portions 30 and 31. The lamp support portion 30 receives the sleeve 37 whereas the connector portion 31 accommodates connector prongs 41, as will be later explained in more detail. The partition 29 has terminal holes 32 extending therethrough to provide for electrical connection of the lamp lead wires 6 to the connector prongs 41. The flange 33 has a plurality of, three in this embodiment but only two seen in FIGS. 2 and 3, positioning recesses 34 defined therein at circumferential spacings.

Formed circumferentially in the outer surface of the lamp base 28, and in the immediate vicinity of the flange 33, is a groove 35 for receiving a sealing ring, not shown. The unshown sealing ring is for use in sealing the joint between the lamp base 28 and a reflector or lamp housing in the intended use of this lamp assembly 1 as a light source of a vehicular headlamp.

At 36 in FIG. 1 is seen a metal-made ring immovably embedded in the lamp support portion 30 of the lamp base 28. The sleeve 37 is spot welded to this ring 36 and so is secured to the lamp base 28, as will be later referred to in further detail.

Reference is directed principally to FIGS. 1 and 3 for a detailed discussion of the metal-made sleeve 37. The sleeve 37 is generally tubular in shape, with an outside diameter determined to fit in the lamp support portion 30 of the lamp base 28 and with an axial dimension less than that of the lamp support portion 30. A series of, for example six to eight, welding tabs 40 are formed on one end, directed away from the lamp 2, of the sleeve 37 at constant circumferential spacings. These welding tabs 40 are spot-welded to the embedded metal ring 36 in order to retain the sleeve 37 within the lamp support portion 30 of the lamp base 28 against any possibility of detachment.

A plurality of, four in this embodiment, connecting fingers 38 extend from circumferentially spaced positions on the other end, directed toward the lamp 2, of the sleeve 37. The connecting fingers 38 are inclined toward the lamp axis A as they extend away from the sleeve and terminate in bent portions 39 to be received with clearances in the respective openings 27 in the pair of seating portions 24 and 25 of the lamp holder 12. The bent terminal portions 39 of the connecting fingers 38 are approximately parallel to the associated lugs 26.

The lamp holder 12, with the lamp 2 firmly attached thereto, is to be coupled to the sleeve 37 after welding the latter to the metal ring 36 embedded in the lamp base 28. The terminal portions 39 of the connecting fingers 38 may first be inserted in the openings 27 in the seating portions 24 and 25 of the lamp holder 12. Then the relative positions of the lamp holder 12 and sleeve 37 may be adjusted in order that the lamp filaments 8 may gain correct positions with respect to the flange 33 of the lamp base 28. With the adjustment completed, the terminal portions 39 of the connecting fingers 38 and the lugs 26 of the lamp holder 12 may be welded together, preferably by plasma-arc welding. The lamp 2 can thus be mechanically coupled to the lamp base 28 via the lamp holder 12 and sleeve 37 in the correct positional relationship.

As seen in FIG. 1, the connector prongs 41 within the connector portion 31 of the lamp base 28 are each formed to include a mounting base 42 in right-angular relation thereto, and a terminal sleeve 43 extending from the mounting base 42 in a direction away from the prong. The connector prongs 41 can be mounted in position within the connector portion 31 of the lamp base 28 by inserting the terminal sleeves 43 in and through the terminal holes 32 in the partition 29 until the mounting bases 42 come to butt on the partition 29 and then by clinching the end portions of the terminal sleeves 43 protruding into the lamp support portion 30 of the lamp base 28.

It will also be noted from FIG. 1 that the lead wires 6 extending outwardly from the pinch seal 4 of the lamp 2 have their terminal portions inserted respectively in the terminal sleeves 43. Electrical connection between lead wires 6 and connector prongs 41 can be established as the terminal portions of the lead wires are soldered at 44 to the mounting bases 42 of the connector prongs.

Figure 6:
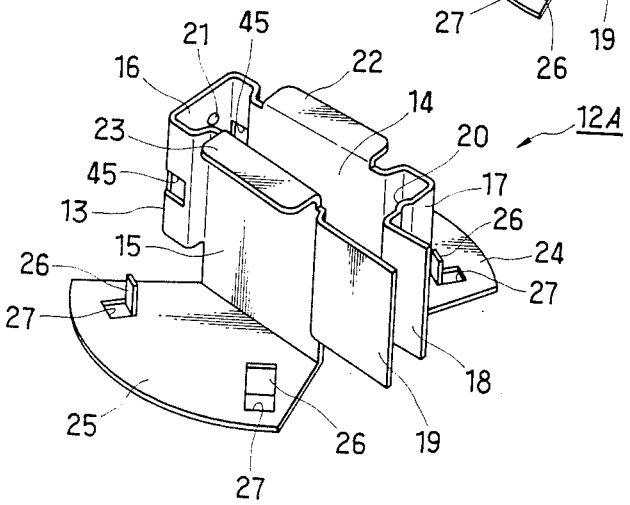
FIG. 6 is a perspective view of an alternative form of lamp holder for use in the lamp assembly of FIG. 1.

FIG. 6 shows a modified lamp holder 12A alternative to the lamp holder 12 of FIGS. 4 and 5. The alternative lamp holder 12A features a pair of openings 45 formed respectively in the longer pair of opposite sides 14 and 15 of the holder portion 13. The openings 45 are located close to the shorter side 16 joining the sides 14 and 15 and in the middle of the holder 13 with respect to its dimension along the lamp axis A. These openings 45 are intended to add elasticity to the side 16 in particular and hence to enable the dot-like inward protuberances 21 thereon to more readily conform to the shape of the lamp seal 4. The lamp holder 12A as a whole will more firmly enage and hold the lamp seal 4.

FIGS. 7–14 illustrate another preferred embodiment of the invention. Generally designated 1*a* in FIGS. 7 and 8, the alternative lamp assembly includes a halogen lamp 2 of single filament construction, having a press or pinch seal 3 at one end and an exhaust tip 4 at the other. A pair of lead wires 5 extend thorugh the lamp seal 4 to provide inner portions 5*a* disposed within the lamp 2 and outer portions 5*b* extending outwardly from the lamp seal. A coiled filament 6 extends between the tips of the inner lead portions 5*a*.

Figure 7:
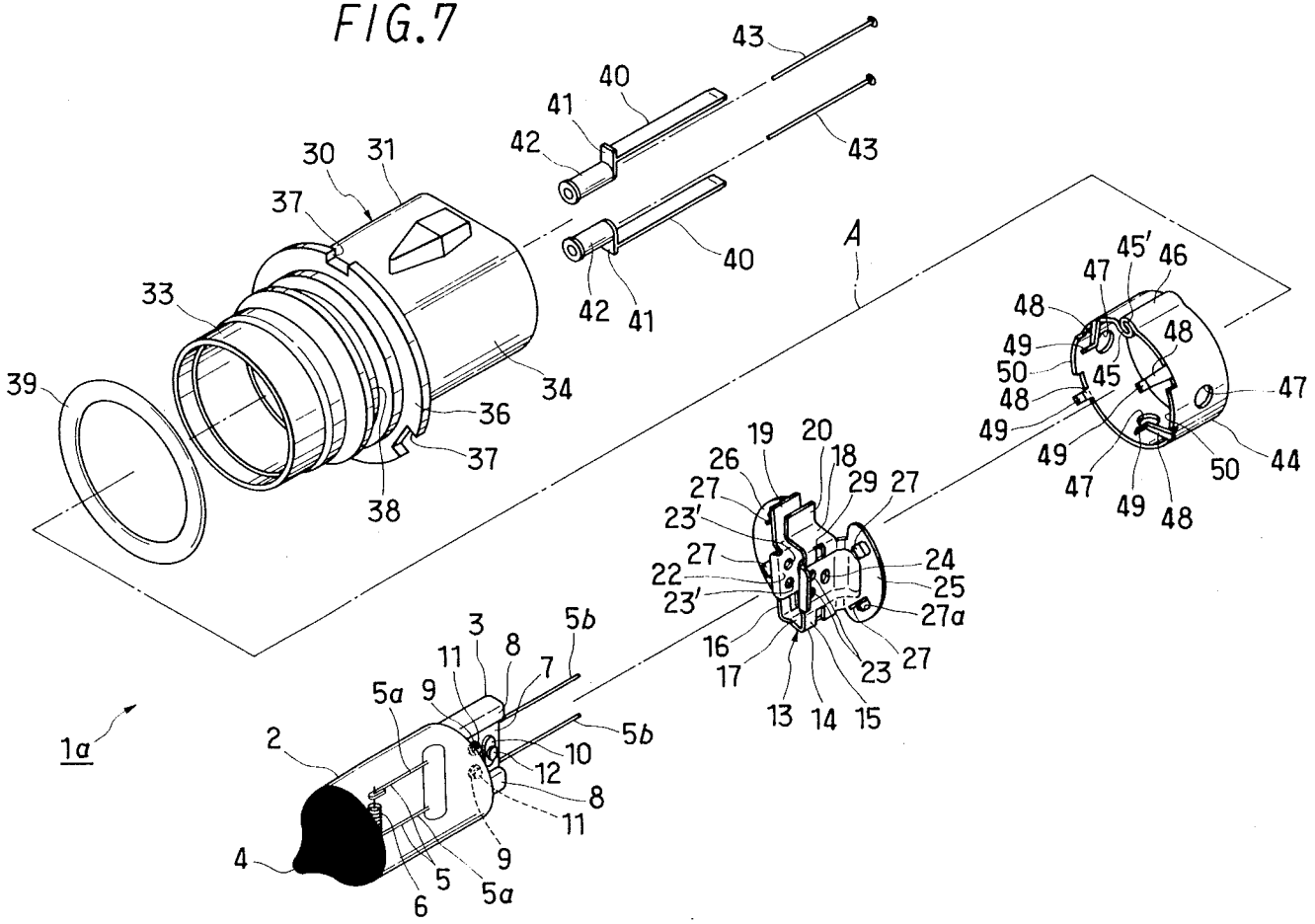
FIG. 7 is an exploded perspective view of another preferred form of halogen-cycle incandescent lamp assembly for automotive headlamp application in accordance with the invention.
Figure 9:
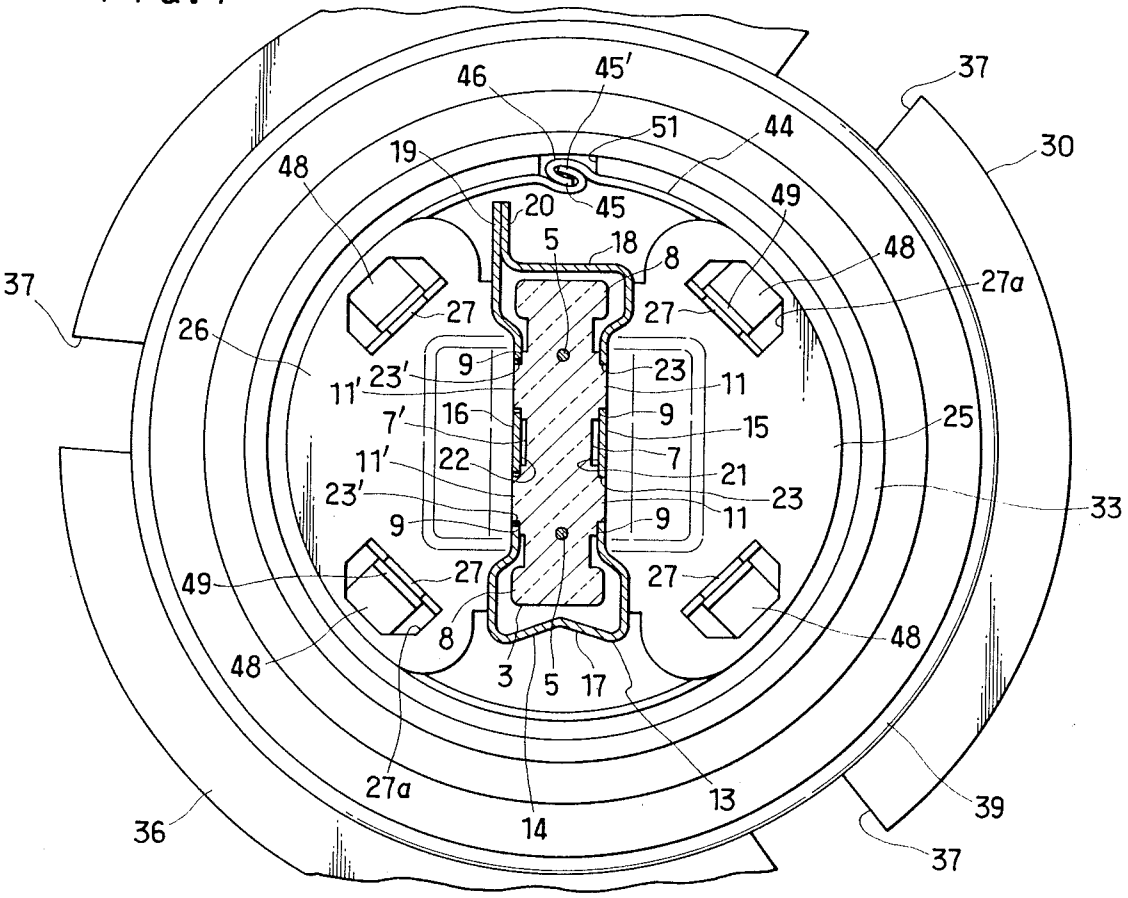
FIG. 9 is an enlarged cross section through the lamp assembly of FIG. 7, taken along the line IX—IX in FIG. 8.
Figure 10:
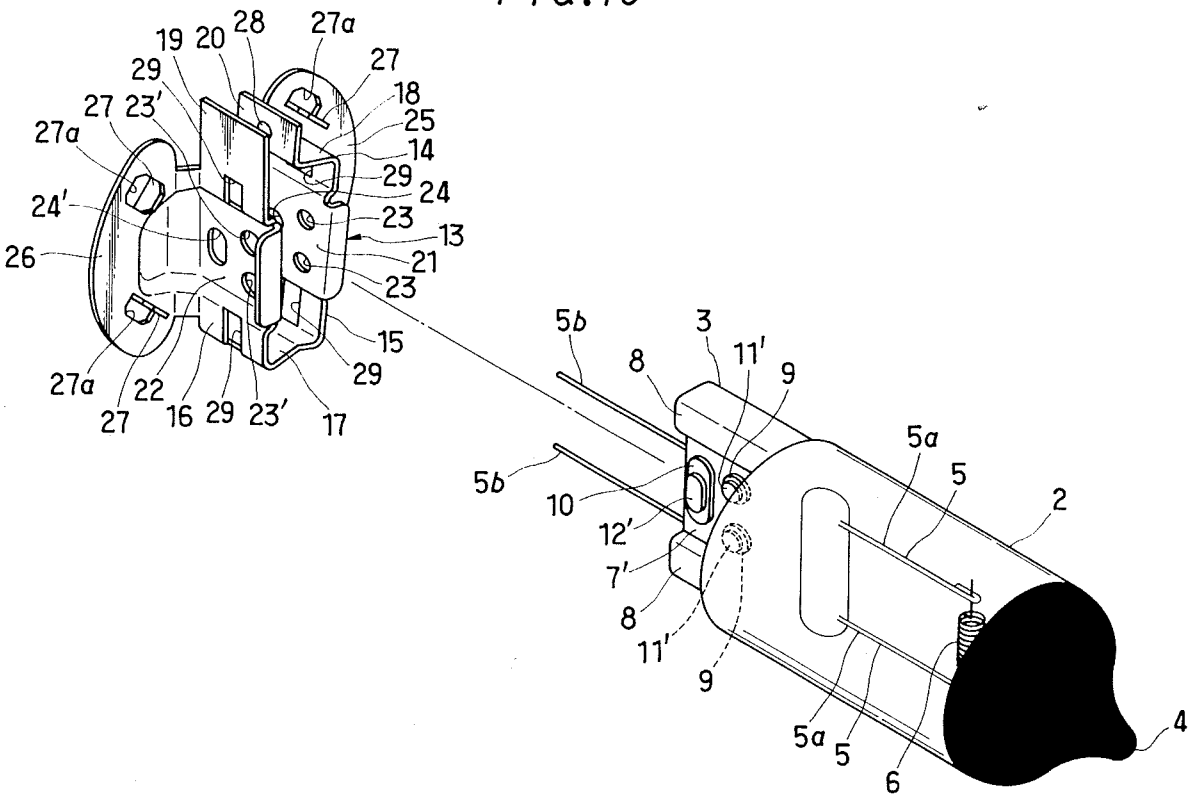
FIG. 10 is an exploded perspective view of the lamp and lamp holder of the lamp assembly of FIG. 7.
Figure 11:
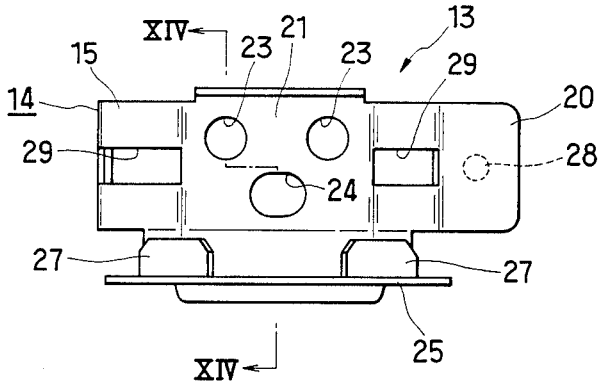
FIG. 11 is an elevation of the lamp holder of the lamp assembly of FIG. 7.
Figure 12:
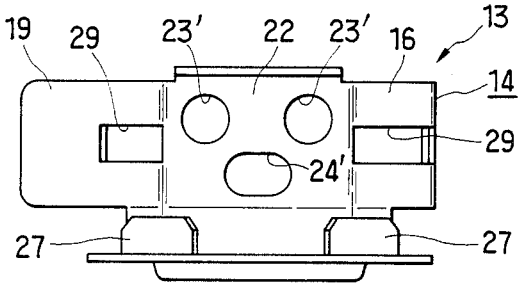
FIG. 12 is a view similar to FIG. 11 except that the lamp holder is shown as seen from the opposite side.

As best shown in FIG. 9, the lamp seal 3 is of generally I-shaped cross section, having a web portion with a pair of opposite surfaces 7 and 7', and a pair of flanges 8 extending along the opposite sides of the web portion. Each of the web surfaces 7 and 7' has formed thereon two protuberances 9 of circular shape and one larger protuberance 10 of elliptical shape. As shown in FIG. 7, each protuberance 9 on the web surface 7 has another circular protuberance 11 of smaller diameter formed thereon, and the protuberance 10 on the same web surface 7 also has a smaller elliptical protuberance 12 formed thereon. Similarly, as depicted in FIG. 10, each protuberance 9 on the other web surface 7' has a smaller circular protuberance 11' formed thereon, and the protuberance 10 on the same web surface 7' has a smaller elliptical protuberance 12' formed thereon.

The circular protuberances 11 and 11' on the opposite web surfaces 7 and 7' are of the same diameter (e.g. 2 mm). However, the elliptical protuberances 12 and 12' differ in shape and size. Although the dimensions of the protuberances 12 and 12' along their minor axis are the same (e.g. 2 mm), the dimension of the protuberance 12 along the major axis is shorter than that of the protuberance 12' (e.g. 2.8 mm and 3.2 mm respectively).

As illustrated in detail in FIGS. 11–14, a lamp holder 13 of this alternative embodiment is also a pressing of resilient sheet-metal material, integrally comprising a holder portion 14 and a pair of seating portions 25 and 26. The holder portion 14 is shaped and sized to fit closely over the lamp seal 3. Thus the holder portion 14 is of generally tubular shape, having a pair of opposite longer sides 15 and 16, a first shorter side 17 right-angularly joining the longer sides 15 and 16 each at one end thereof, and a second shorter side 18 bent right-angularly from the other end of the longer side 15 into opposed relation to the first shorter side 17. The second shorter side 18 has a fin 20 bent right-angularly therefrom in a direction away from the first shorter side 17. Another fin 19 extends from the longer side 16 into opposed relation to the fin 20. These fins 19 and 20 are to be welded or otherwise joined to each other when the lamp holder 12 is mounted in place on the lamp 2 as in FIGS. 8 and 9.

Figure 13:
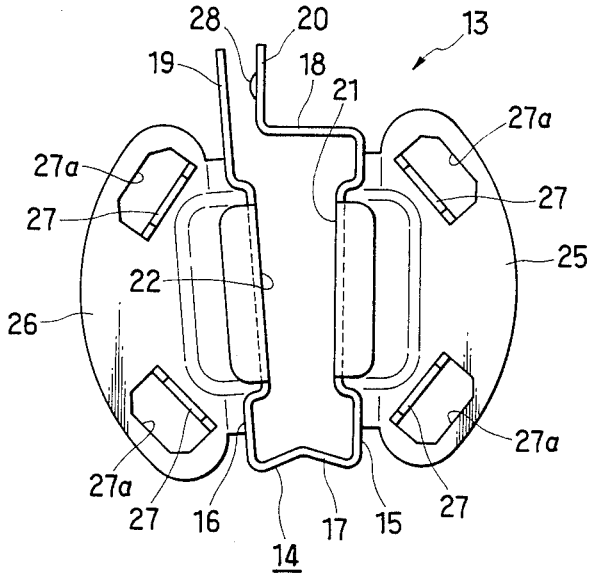
FIG. 13 is a plan view of the same lamp holder.
Figure 14:
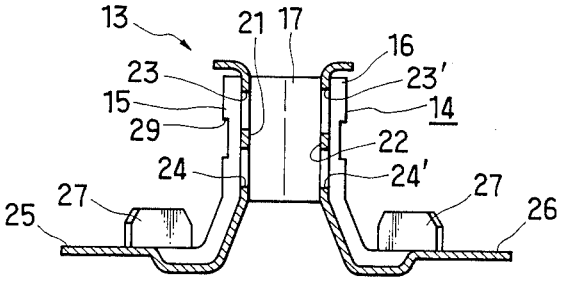
FIG. 14 is a section through the same lamp holder, taken along the line XIV—XIV in FIG. 11.

It will be noted from FIGS. 9 and 13 in particular that the pair of longer sides 15 and 16 of the holder portion 14 have their midportions 21 and 22 depressed toward each other. Therefore, when the fins 19 and 20 are joined together, the holder portion 14 bounds a space of approximately the same shape and size as the cross section of the lamp seal 3. Each of the longer sides 15 and 16 has defined therein a pair of apertures 29 disposed on both sides of the depressed midportion 21 and 22. These apertures 29 will make easier the bending of the various sides and fins of the holder portion 14 at the time of the fabrication of the lamp holder 13 and, additionally, will enable the holder portion 14 to make more intimate contact with the lamp seal 3.

The depressed midportion 21 of the side 15 has defined therein two circular openings 23 and one elliptical opening 24 for receiving the protuberances 11 and 12, respectively, on the web surface 7 of the lamp seal 3. A close fit of the protuberances 11 and 12 in the openings 23 and 24 is desired, so that the openings 23 and 24 should be of the same dimensions as the noted dimensions of the protuberances 11 and 12.

The other depressed midportion 22 of the side 16 also has defined therein two circular openings 23' and one elliptical opening 24' for receiving the protuberances 11' and 12', respectively, on the web surface 7' of the lamp seal 3. The openings 23' should somewhat loosely receive the protuberances 11'. Thus, if the diameter of each circular protuberance 23' is 2 mm as aforesaid, then the diameter of each circular opening may be 2.2 mm. The elliptical opening 24', however, should closely receive the elliptical protuberance 12', so that they should be of the same size.

The noted pair of seating portions 25 and 26 extend from the pair of longer sides 15 and 16 of the holder portion 14 so as to be generally contained in a plane at right angles with the lamp axis A. The seating portions 25 are each shaped like a semicircle in this alternative lamp assembly 1*a*, although they could be shaped like sectors of a common circle as in the lamp assembly 1. Each seating portion has a pair of punched-out lugs 27, creating openings 27*a* therein.

The halogen lamp 2 and lamp holder 13 may be assemblied by first inserting the lamp seal 3 in the holder portion 14 of the lamp holder, with its fins 19 and 20 held slightly open as in FIGS. 7, 10 and 13, until the lamp bottoms against the the depressed midportions 21 and 22 of the lamp holder sides 15 and 16. Then, as the fins 19 and 20 are closed against each other, the protuberances 11, 11', 12 and 12' on the lamp seal 3 will become engaged in the corresponding openings 23, 23', 24 and 24' in the lamp holder 13. Then the fins 19 and 20 may be secured to each other as by spot welding. A small projection 28 on the fin 20 is intended to expedite such spot welding of the fins 19 and 20.

Now the halogen lamp 2 and lamp holder 13 have been firmly coupled together in their prescribed relative positions. It is to be noted that the elliptical protuberances 12 and 12' on the opposite sides of the lamp seal 3 differ in size, and the elliptical openings 24 and 24' in the opposite sides 15 and 16 of the lamp holder 13 are shaped and sized to closely receive the differentsize protuberances 12 and 12' respectively. The lamp 2 can therefore be coupled to the lamp holder 13 only in the correct orientation relative to the latter.

Figure 8:
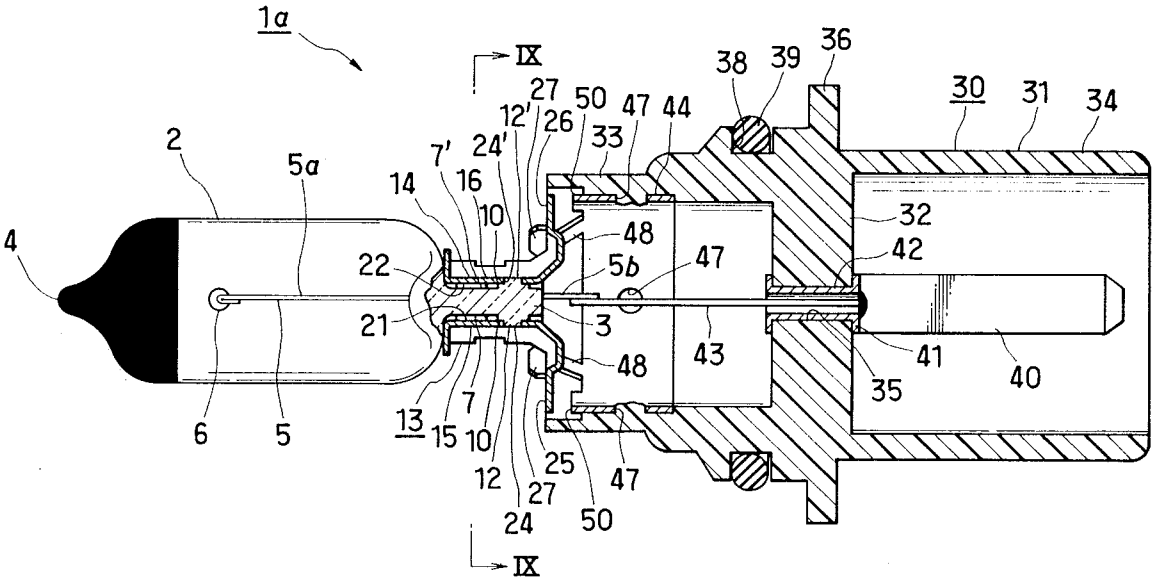
FIG. 8 is an axial section, partly in elevation, through the lamp assembly of FIG. 7.

The reference numeral 30 in FIGS. 7–9 generally denotes lamp base means comprising a lamp base 31, connector prongs 40 and sleeve 44. The lamp base 31 is a one-piece molding of a plastic, preferably a thermoplastic. Substantially tubular in shape, the lamp base 31 has a lamp support portion 33 and a connector portion 34, with a partition 32 and flange 36 at the boundary between the two portions 33 and 34. The lamp support portion 33 receives the sleeve 44 whereas the connector portion 34 accommodates the connector prongs 40, as will be later explained in more detail. The partition 32 has a pair of terminal holes 35, one seen in FIG. 8, extending therethrough to provide for electrical connection of the lamp lead wires 5 to the connector prongs 40. The flange 36 has a plurality of, three in this embodiment, positioning recesses 37 defined therein at circumferential spacings.

Formed circumferentially in the outer surface of the lamp base 31, and in the immediate vicinity of the flange 36, is a groove 38 for receiving a sealing ring 39. This sealing ring 39 is for use in sealing the joint between the lamp base 31 and a reflector or lamp housing in the intended use of this lamp assembly 1*a* as a light source of a vehicular headlamp.

As seen in FIG. 1, the connector prongs 40 within the connector portion 34 of the lamp base 31 are each formed to include a mounting base 41 in right-angular relation thereto, and an offset terminal sleeve 42 extending from the mounting base 41 in a direction away from the prong. The connector prongs 40 can be mounted in position within the connector portion 34 of the lamp base 31 by inserting the terminal sleeves 42 in and through the terminal holes 35 in the partition 32 until the mounting bases 41 come to butt on the partition 32 and then by clinching the end portions of the terminal sleeves 42 protruding into the lamp support portion 33 of the lamp base 31.

Extending through each terminal sleeve 42 is a connective wire 43 having one extremity soldered to the mounting base 41 of the associated terminal sleeve. The other extremities of the connective wires 43 are welded to the outer portions 5*b* of the lamp leads 5.

Reference is directed principally to FIGS. 7 and 8 for a detailed discussion of the metal-made sleeve 44. This sleeve is fabricated by curling a band of sheet metal into tubular shape, with the meeting ends 45 and 45' of the band folded into interfitting relation to each other as in FIG. 7, and by exerting pressures on these meeting ends in both radially inward and outward directions of the sleeve. The interfitting ends 45 and 45' provide a ridge 46 extending parallel to the lamp axis A. So fabricated, the sleeve 44 has an outside diameter determined to fit in the lamp support portion 33 of the lamp base 31, and an axial dimension significantly less than that of the lamp support portion 33. A series of holes 47 are formed in the sleeve 44 at circumferential spacings.

A plurality of, four in this embodiment, connecting fingers 48 extend from circumferentially spaced positions on one end, directed toward the lamp 2, of the sleeve 44. The connecting fingers 48 are inclined toward the lamp axis A as they extend away from the sleeve and terminate in bent portions 49 to be received with clearances in the respective openings 27*a* in the pair of seating portions 25 and 26 of the lamp holder 13. The bent terminal portions 49 of the connecting fingers 48 are approximately parallel to the associated lugs 27.

It will be noted from FIG. 7 that the sleeve 44 has a pair of tongues 50 extending toward the lamp 2 from diametrically opposite positions on one end thereof. These tongues are intended to facilitate the manual or mechanical insertion of the sleeve 44 in the lamp support portion 33 of the lamp base 31.

For mounting the sleeve 44 in position in the lamp support portion 33 as in FIG. 8, the sleeve may first be inserted in the lamp support portion with the ridge 46 of the sleeve engaged in a guide groove 51, FIG. 9, which is formed in the inside surface of the lamp support portion and which extends parallel to the lamp axis A. The sleeve 44 can thus be disposed in a prescribed angular position with respect to the lamp base 31. Then the sleeve 44 may be heated ultrasonically until the lamp support portion 33 becomes molten to such an extent as to fill in the holes 47 in the sleeve. FIG. 8 shows the sleeve 44 thus retained in the lamp support portion 33 against the likelihood of dislodgement.

The lamp holder 13, with the lamp 2 firmly attached thereto as above stated, is to be coupled to the sleeve 44 after mounting the latter to the lamp base 31. Toward this end the terminal portions 49 of the connecting fingers 48 may first be inserted in the openings 27*a* in the seating portions 25 and 26 of the lamp holder 13. Then the relative positions of the lamp holder 13 and sleeve 44 may be adjusted in order that the lamp filament 6 may gain a correct position with respect to the flange 36 on the lamp base 31. With the adjustment completed, the terminal portions 49 of the connecting fingers 48 and the lugs 27 of the lamp holder 13 may be welded together, preferably by plasma-arc welding. The lamp 2 can thus be mechanically coupled to the lamp base 31 via the lamp holder 13 and sleeve 44 in the correct positional relationship. The lamp filament 6 can be electrically coupled to the connector prongs 40 and the outer portions **5*b* of the lamp leads 5 are welded to the connecting wires 43**.

Thus, in this alternative lamp assembly **1*a*, too, the halogen lamp 2 and lamp holder 13 can be coupled together in the correct positional relationship by virtue of the interfitting protuberances on the lamp seal 3 and the openings in the lamp holder. Accordingly, the correct positional relationship between lamp 2 and lamp base 31 can also be established as the relative positions of the lamp holder 13 and sleeve 44** are adjusted, the sleeve being positively maintained in place on the lamp base.

It should also be appreciated that some of the protuberances on the lamp seal and the openings in the lamp holder make a close fit whereas the others make a loose fit. As has been ascertained by experiment, this leads to the elimination of the destruction of the protuberances under the rigorous conditions of the use of the lamp assembly as light sources of vehicle headlamps. It will be apparent, however, that the through openings in the lamp holder might be replaced by depressions or similar recesses capable of positive engagement with the protuberances on the lamp seal, although the through openings are preferred by reasons of the ease of manufacture and reliability in operation.

What is claimed is:

1. An electric lamp assembly comprising:

(a) a baseless incandescent lamp comprising an envelope having a hermetic end seal, a filament within the envelope, and lead wires connected to the filament and extending from within the envelope through the end seal thereof;

(b) a metal-made lamp holder comprising a holder portion rigidly holding the envelope seal, and a seating portion having a plurality of openings defined therein and also having a plurality of lugs disposed one adjacent each opening;

(c) a plastic lamp base;

(d) connector means mounted to the lamp base and electrically connected to the lead wires of the lamp; and (e) a metal-made sleeve rigidly anchored in the lamp base and having a plurality of fingers extending therefrom, the fingers being loosely engaged in the respective openings in the seating portion of the lamp holder and rigidly connected to the respective lugs thereon.

2. The electric lamp assembly of claim 1 wherein the fingers of the metal-made sleeve and the lugs of the metal-made lamp holder have welded connections therebetween whereby the positional relationship between the lamp and the lamp base can be adjusted one with respect to the other by moving, with the sleeve fingers loosely engaged in the lamp holder openings, the lamp holder and the sleeve with respect to each other before welding the sleeve fingers to the lamp holder lugs.

3. The electric lamp assembly of claim 1 wherein the end seal of the lamp envelope is of generally I shaped cross section having a web portion and a pair of side flanges, wherein the lamp holder is of resilient sheet-metal material, and wherein the holder portion of the lamp holder has a first pair of opposite sides held opposite the web portion of the lamp seal, and a second pair of opposite sides held opposite the side flanges of the lamp seal, one of the second pair of opposite sides having at least two protuberances held against one of the side flanges of the lamp seal, the other of the second pair of opposite sides having at least one protuberance held against the other side flange of the lamp seal.

4. The electric lamp assembly of claim 3 wherein the lamp has a center axis, and wherein the protuberances on said one of the second pair of opposite sides of the holder portion are spaced from each other along the center axis of the lamp.

5. The electric lamp assembly of claim 3 wherein the first pair of opposite sides of the holder portion have defined therein apertures located adjacent to said one of the second pair of opposite sides in order to add elasticity thereto.

6. The electric lamp assembly of claim 1 wherein the end seal of the lamp envelope has a plurality of protuberances, and wherein the holder portion of the lamp holder has recesses for engagement with the respective protuberances on the lamp seal, some of the protuberances being loosely engaged in the associated recesses, and the other protuberances being closely engaged in the other associated recesses.

* * * * *